US009674614B2

(12) United States Patent
Yoon et al.

(10) Patent No.: US 9,674,614 B2
(45) Date of Patent: Jun. 6, 2017

(54) SPEAKER UNIT

(71) Applicant: SAMSUNG ELECTRONICS CO., LTD., Suwon-si (KR)

(72) Inventors: Ho Jin Yoon, Yongin-si (KR); Min Kim, Suwon-si (KR); Tae Myun Kim, Suwon-si (KR); Seong Min Park, Yongin-si (KR); Won Youl Bae, Gwacheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/738,161

(22) Filed: Jun. 12, 2015

(65) Prior Publication Data

US 2015/0365769 A1 Dec. 17, 2015

(30) Foreign Application Priority Data

Jun. 13, 2014 (KR) ..... 10-2014-0072437

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01)

(58) Field of Classification Search
CPC ..... H04R 9/06; H04R 11/02; H04R 1/025; H04R 2499/11; H04R 31/006; H04R 9/025; H04R 1/1016; H04R 1/24; H04R 1/26; H04R 2231/003; H04R 2307/207; H04R 2400/03; H04R 5/023; H04R 7/06; H04R 7/12; H04R 7/127
(Continued)

(56) References Cited

U.S. PATENT DOCUMENTS 4,590,332 A * 5/1986 Delbuck ..... H04R 1/025 381/186
7,099,489 B2 * 8/2006 Pan ..... H04R 9/06 381/182

(Continued)

FOREIGN PATENT DOCUMENTS

JP 2010-10791 A 1/2010
JP 2010010791 A * 1/2010

OTHER PUBLICATIONS

Communication dated Nov. 6, 2015, issued by the European Patent Office in counterpart European Application No. 15169955.0.

(Continued)

*Primary Examiner* — Md S Elahee
*Assistant Examiner* — Julie X Dang
(74) *Attorney, Agent, or Firm* — Sughrue Mion, PLLC

(57) ABSTRACT

A speaker unit includes a magnet having poles and generating magnetic flux, and a yoke part forming a path of the magnetic flux and including a first yoke extending from one of the poles, a second yoke extending from another one of the poles, and magnetic gaps disposed between the first yoke and the second yoke. The speaker unit further includes a voice coil disposed between the magnetic gaps and moving when applied with an electric current, and a diaphragm generating sound pressure while vibrating according to the movement of the voice coil. The first yoke includes magnetic plates protruding toward the second yoke, and the magnetic plates have thicknesses different from each other.

30 Claims, 15 Drawing Sheets

(58) Field of Classification Search
USPC ..... 381/396, 343, 399, 431, 400–422; 335/302, 306
See application file for complete search history.

(56) References Cited

U.S. PATENT DOCUMENTS

| | | | | |
|---|---|---|---|---|
| 7,227,970 | B2 * | 6/2007 | Calderwood | H04R 9/025 381/412 |
| 7,929,726 | B1 * | 4/2011 | Jones | H04R 9/047 381/343 |
| 2002/0097890 | A1 * | 7/2002 | Kobayashi | H04R 11/00 381/412 |
| 2003/0133587 | A1 | 7/2003 | Hyre et al. | |
| 2003/0152246 | A1 | 8/2003 | Tanabe | |
| 2004/0086150 | A1 * | 5/2004 | Stiles | H04R 9/025 381/421 |
| 2005/0226457 | A1 | 10/2005 | Milot et al. | |
| 2006/0072777 | A1 * | 4/2006 | Ohashi | H04R 7/18 381/430 |
| 2011/0129112 | A1 * | 6/2011 | Satoh | H04R 9/06 381/413 |
| 2012/0243722 | A1 * | 9/2012 | Huang | H04R 31/006 381/371 |
| 2013/0011000 | A1 * | 1/2013 | Xi | H04R 1/24 381/412 |
| 2014/0140543 | A1 * | 5/2014 | Yi | H04R 7/20 381/162 |

OTHER PUBLICATIONS

Communication dated Nov. 16, 2016, issued by the European Patent Office in counterpart European Application No. 15169955.0.

* cited by examiner

SPEAKER UNIT

CROSS-REFERENCE TO RELATED APPLICATION

This application claims the benefit of Korean Patent Application No. 2014-0072437, filed on Jun. 13, 2014, in the Korean Intellectual Property Office, the disclosure of which is incorporated herein by reference in its entirety.

BACKGROUND

1. Field

Apparatuses consistent with exemplary embodiments relate to a speaker unit having an improved sound quality while increasing a moved distance of a voice coil.

2. Description of the Related Art

In general, a speaker unit is provided with a magnetic circuit part including a magnet generating a magnetic flux, a yoke part providing a path of magnetic flux, and a bobbin around which a voice coil is wound, and a vibration system including a frame, a diaphragm vibrating according to movement of the bobbin, a damper adjusting a direction in which the diaphragm vibrates, and an edge fixing an outer circumference of the diaphragm to the frame. The voice coil magnetized by being applied with an electric current moves forward and backward by interacting with the magnetic flux generated from the magnet, and accordingly, the diaphragm vibrates to generate a sound pressure.

In detail, the yoke part includes a first yoke extending from one of poles of the magnet, a second yoke extending the other pole of the magnet, and a discontinuous magnetic gap formed between the first yoke and the second yoke, and the voice coil is disposed in the magnetic gap. Such a conventional structure of the speaker includes only a single magnetic gap, so there is a limitation in increasing a moved distance of the voice coil. In addition, a large amount of magnetic flux is leaked without passing through the magnetic gap, failing to produce a sufficient level of sound pressure compared to the capacity of a magnet.

SUMMARY

Therefore, it is an aspect of an exemplary embodiment to provide a speaker unit having an improved sound quality by increasing a moved distance of a voice coil and reducing magnetic flux leakage.

It is another aspect of an exemplary embodiment to provide a speaker unit having sound quality distinguished from general sound quality through an unbalance structure.

In accordance with one aspect of an exemplary embodiment, there is provided a speaker unit including a magnet having poles and generating magnetic flux, and a yoke part forming a path of the magnetic flux and including a first yoke extending from one of the poles, a second yoke extending from another one of the poles, and magnetic gaps disposed between the first yoke and the second yoke. The speaker unit further includes a voice coil disposed between the magnetic gaps and moving when applied with an electric current, and a diaphragm generating sound pressure while vibrating according to the movement of the voice coil. The first yoke includes magnetic plates protruding toward the second yoke, and the magnetic plates have thicknesses different from each other.

The magnetic plates may include a first magnetic plate provided at a rear side and a second magnetic plate provided at a front side.

The second magnetic plate may have a thickness greater than a thickness of the first magnetic plate.

The second magnetic plate may have a thickness smaller than a thickness of the first magnetic plate.

The first yoke may further include a spacer plate disposed between the first magnetic plate and the second magnetic plate.

An empty space may be disposed between the first magnetic plate, the second magnetic plate, and the spacer plate.

The first magnetic plate, the spacer plate, and the second magnetic plate may be separately formed from each other and coupled to each other.

The first magnetic plate, the spacer plate, and the second magnetic plate may be integrally formed with each other.

The first magnetic plate and the spacer plate may be integrally formed with each other, and the second magnetic plate may be separately formed from the first magnetic plate and the spacer plate and coupled to the spacer plate.

The voice coil may have a height equal to a sum of the thickness of the first magnetic plate and a thickness of the spacer plate.

The voice coil may have a height equal to a sum of the thickness of the second magnetic plate and a thickness of the spacer plate.

The voice coil may have a height equal to a sum of a half of the thickness of the first magnetic plate, a thickness of the spacer plate, and a half of the thickness of the second magnetic plate.

The voice coil may have a height equal to a sum of the thickness of the first magnetic plate, a thickness of the spacer plate, and the thickness of the second magnetic plate.

The voice coil may have a height greater than a sum of the thickness of the first magnetic plate, a thickness of the spacer plate, and the thickness of the second magnetic plate.

The voice coil may have a height smaller than a sum of the thickness of the first magnetic plate, a thickness of the spacer plate, and the thickness of the second magnetic plate.

The first yoke may further include a short ring disposed in an empty space disposed between the first magnetic plate, the second magnetic plate, and the spacer plate, the short ring concentrating the magnetic flux on the magnetic plate and supporting the magnetic plate.

The short ring may have a magnetic permeability lower than a magnetic permeability of the magnetic plate.

The short ring may have a shape of a closed ring.

The short ring may have a shape of a ring having disconnected ends.

The first yoke may further include a magnetically permeable adhesive member disposed between the disconnected ends of the short ring.

In accordance with another aspect of an exemplary embodiment, there is provided a speaker unit including a magnet having poles and generating magnetic flux, a pole piece forming a path of the magnetic flux, and a first magnetic plate forming a first magnetic gap between the pole piece and the first magnetic plate. The speaker unit further includes a spacer plate disposed on the first magnetic plate, a second magnetic plate disposed on the spacer plate and forming a second magnetic gap between the pole piece and the second magnetic plate, and a short ring inserted into a groove formed between the first magnetic plate, the second magnetic plate, and the spacer plate. The speaker unit further includes a voice coil moving while disposed in the first magnetic gap and the second magnetic gap.

The first magnetic plate and the second magnetic plate may have a same thickness as each other.

The first magnetic plate and the second magnetic plate may have thicknesses different from each other.

The short ring may have a magnetic permeability lower than a magnetic permeability of the first magnetic plate and a magnetic permeability of the second magnetic plate.

The short ring may have a shape of a closed ring.

The short ring may have a shape of a ring having disconnected ends.

The speaker unit may further include a magnetically permeable adhesive member disposed between the disconnected ends of the short ring.

In accordance with another aspect of an exemplary embodiment, there is provided a speaker unit including a first magnet having poles and generating magnetic flux, a pole piece forming a path of the magnetic flux, and a first magnetic plate disposed on the magnet and forming a first magnetic gap between the pole piece and the first magnetic plate. The speaker unit further includes a second magnet disposed on the first magnetic plate, a second magnetic plate disposed on the second magnet and forming a second magnetic gap between the pole piece and the second magnetic plate, and a voice coil moving while disposed in the first magnetic gap and the second magnetic gap.

The first magnetic plate and the second magnetic plate may have thicknesses different from each other.

The spacer plate and the second magnetic plate may be integrally formed with each other, and the first magnetic plate may be separately formed from the spacer plate and the second magnetic plate and coupled to the spacer plate.

BRIEF DESCRIPTION OF THE DRAWINGS

These and/or other aspects of the exemplary embodiments will become apparent and more readily appreciated from the following description of the embodiments, taken in conjunction with the accompanying drawings of which.

DETAILED DESCRIPTION OF THE EXEMPLARY EMBODIMENTS

Figure 1:
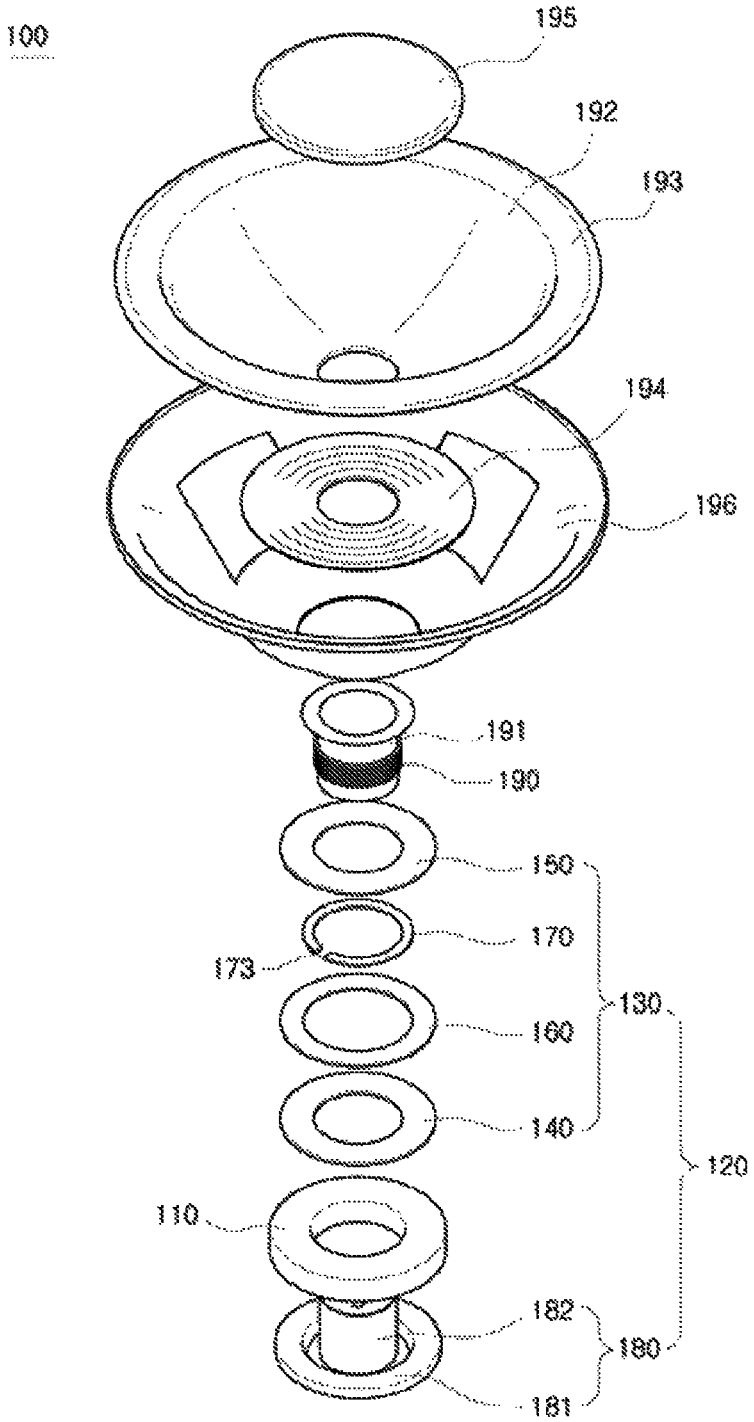
FIG. 1 is an exploded perspective view illustrating a configuration of a speaker unit in accordance with a first exemplary embodiment.

Reference will now be made in detail to the exemplary embodiments, examples of which are illustrated in the accompanying drawings, wherein like reference numerals refer to like elements throughout.

Figure 2:
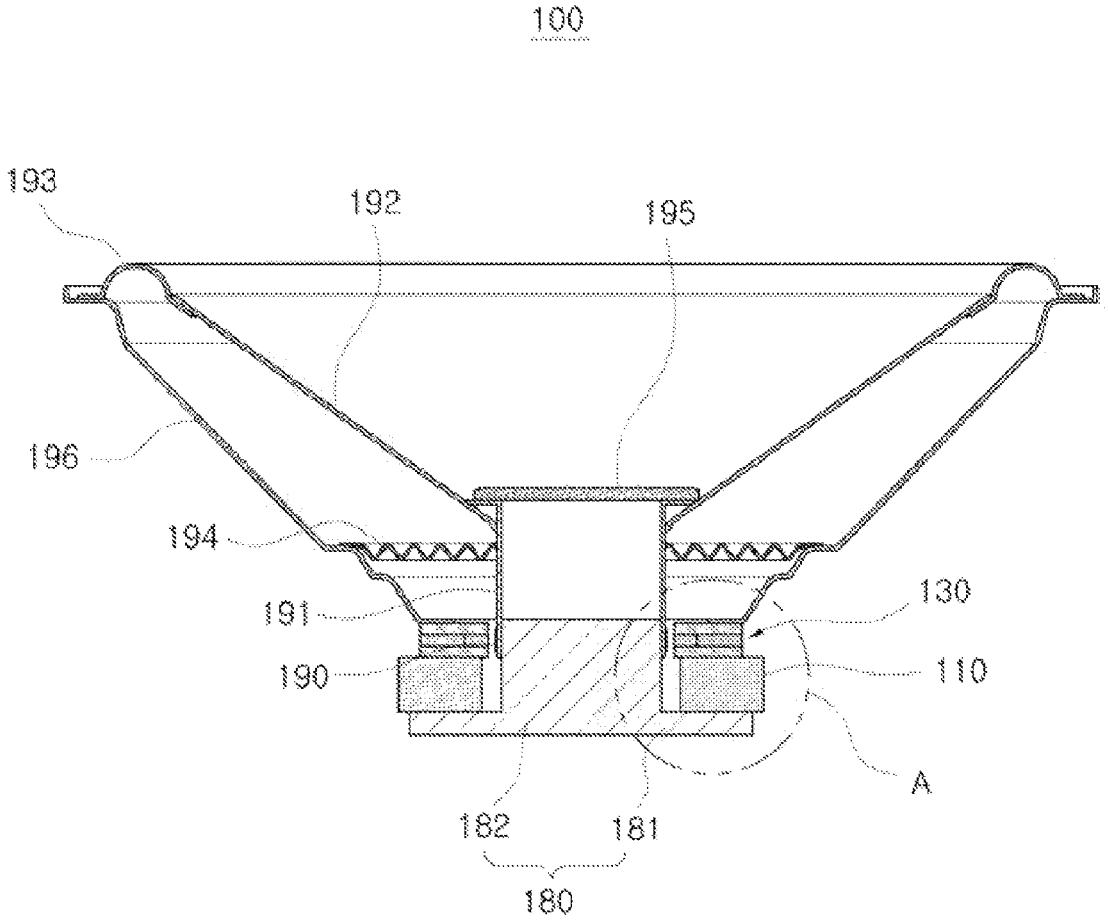
FIG. 2 is a cross-sectional view illustrating the speaker unit of FIG. 1.
Figure 3:
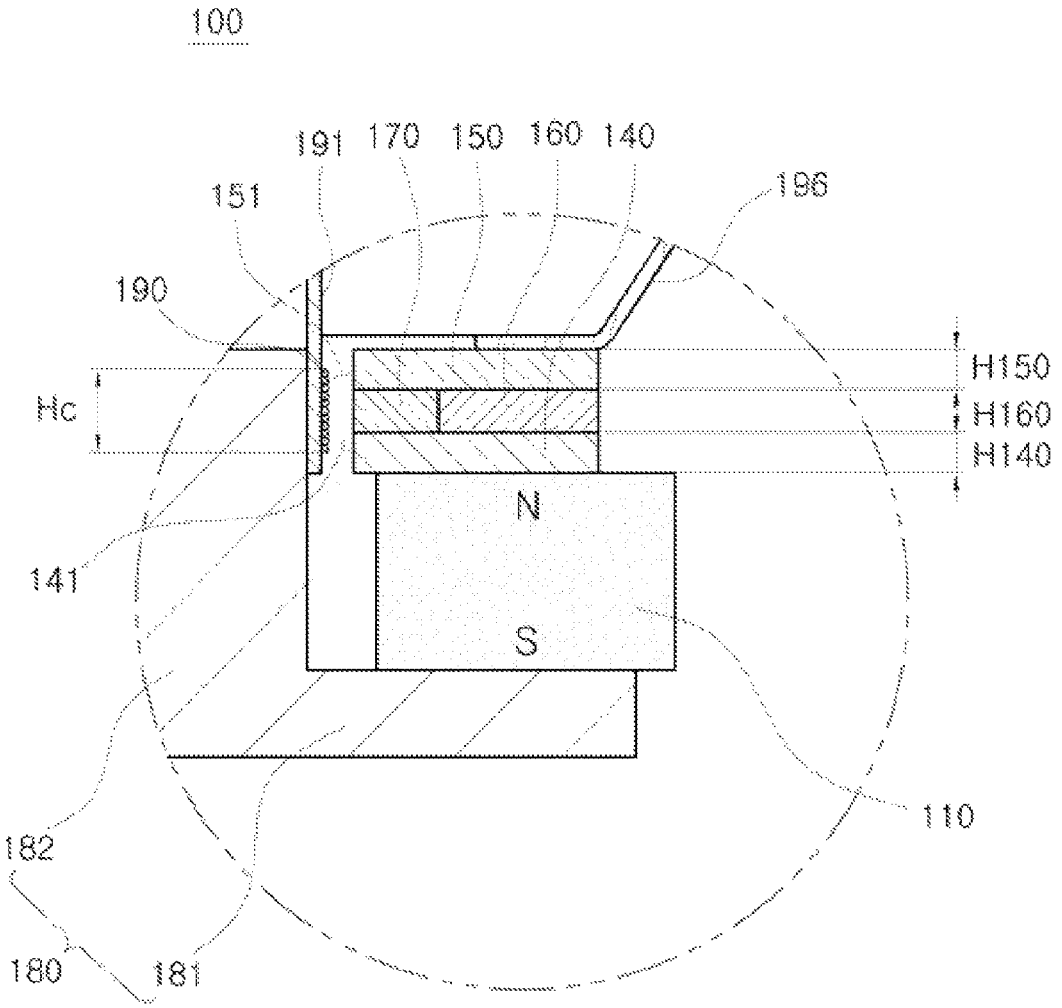
FIG. 3 is an enlarged cross-sectional view illustrating portion 'A' of the speaker unit of FIG. 1.

FIG. 1 is an exploded perspective view illustrating a configuration of a speaker unit in accordance with a first exemplary embodiment, FIG. 2 is a cross-sectional view illustrating the speaker unit of FIG. 1, and FIG. 3 is an enlarged cross-sectional view illustrating portion 'A' of the speaker unit of FIG. 1.

Referring to FIGS. 1 to 3, a speaker unit 100 includes a magnetic circuit part and a vibration system. The magnetic circuit part includes a magnet 110 generating magnetic flux, a yoke part 120 forming a path of the magnetic flux generated by the magnet 110, a voice coil 190 moving while interacting with the magnetic flux generated by the magnet 110 by being magnetized when applied with an electric current, and a bobbin 191 wound by the voice coil 190.

The magnet 110 has a plurality of poles including a single N pole and a single S pole, and magnetized in a direction leading from a front side to a rear side. In the following description, a forward direction refers to a direction in which sound wave proceeds in the speaker unit 100, and corresponds to an upper portion of FIG. 1, and a backward direction refers to a direction opposite to the forward direction and corresponds to a lower portion of FIG. 1.

The magnet 110 may include neodymium, ferrite, or other permanent magnetic material. The magnet 110 may be provided in the shape of a ring having hollowness.

The yoke part 120 includes a first yoke 130, a second yoke 180, and a plurality of magnetic gaps 141 and 151 formed between the first yoke 130 and the second yoke 180.

The first yoke 130 is disposed radially outside the second yoke 180, and includes a first magnetic plate 140, a spacer plate 160 stacked in front of the first magnetic plate 140, a second magnetic plate 150 stacked in front of the spacer plate 160, and a short ring 170 inserted in an empty space formed between the first magnetic plate 140, the spacer plate 160, and the second magnetic plate 150.

The first magnetic plate 140, the spacer plate 160 and the second plate 150 may be formed of steel, an alloy, or magnetic material having a low magnetic resistance. The first magnetic plate 140, the spacer plate 160, and the second magnetic plate 150 may be separately formed from each other and coupled to each other. The first magnetic plate 140, the spacer plate 160 and the second magnetic plate 150 may be coupled through an adhesive member or a fastening member, such as a screw. As such, since the first magnetic plate 140, the spacer plate 160 and the second magnetic plate 150 may be separately formed from each other and coupled to each other, the assembly of the short ring 170 may be easily achieved.

The first magnetic plate 140 is stacked in front of the magnet 110. The first magnetic plate 140 may be provided in an approximate ring shape having hollowness. A pole piece 182 of the second yoke 180 is inserted into the hollowness. The first magnetic plate 140 is provided in a leveled shape having a constant thickness H140.

The second magnetic plate 150 may be provided in an approximate ring shape having hollowness. The pole piece 182 of the second yoke 180 is inserted into the hollowness. The second magnetic plate 150 is provided in a leveled shape having a constant thickness H150.

The first magnetic plate 140 and the second magnetic plate 150 may have the same shape as each other. The thickness H140 of the first magnetic plate 140 may be equal to the thickness H150 of the second magnetic plate 150. Since the thickness H140 of the first magnetic plate 140 may be equal to the thickness H150 of the second magnetic plate 150, the voice coil 190 may perform a linear motion.

The spacer plate 160 is provided between the first magnetic plate 140 and the second magnetic plate 150 such that the first magnetic plate 140 is spaced apart from the second magnetic plate 150 by a predetermined interval. The spacer plate 160 may be provided in an approximate ring shape having hollowness. The pole piece 182 of the second yoke 180 is inserted into the hollowness. The spacer plate 160 is provided in a leveled shape having a constant thickness H160.

The first magnetic plate 140 and the second magnetic plate 150 protrudes toward the pole piece 182 of the second yoke 180 beyond the spacer plate 160. Accordingly, an empty space is formed between a front surface of the first magnetic plate 140, a rear surface of the second magnetic plate 150, and an inner surface of the spacer plate 160. The short ring 170 is inserted in the empty space.

The short ring 170 is formed of material having a magnetic permeability lower than those of the first magnetic plate 140 and the second magnetic plate 150, such that magnetic flux is further concentrated on the first magnetic plate 140 and the second magnetic plate 150. In addition, the short ring 170 comes into close contact with the first magnetic plate 140 and the second magnetic plate 150, thereby firmly supporting the first magnetic plate 140 and the second magnetic plate 150. The short ring 170 may be provided in the form of a closed ring or a disconnected ring.

The second yoke 180 includes a back plate 181 provided at a rear side of the magnet 110 to support the magnet 110, and the pole piece 182 protruding from a center portion of the back plate 181 in a forward direction.

Such a configuration of the yoke part 120 forms a first magnetic gap 141 between the first magnetic plate 140 and the pole piece 182 and a second magnetic gap 151 between the second magnetic plate 150 and the pole piece 182. Accordingly, the yoke part 120 has a line of magnetic force departing from the N pole of the magnet 110 and reaching the S pole of the magnet 110 by passing through the first magnetic plate 140, the first magnetic gap 141, the pole piece 182, and the back plate 181, and a line of magnetic force departing from the N pole of the magnet 110 and reaching the S pole of the magnet 110 by passing through the first magnetic plate 140, the spacer plate 160, the second magnetic plate 150, the second magnetic gap 151, the pole piece 182, the back plate 181, and the magnet 110.

The first magnetic gap 141 and the second magnetic gap 151 are disposed one behind the other while having a predetermined interval therebetween, so that a moved distance of the voice coil 190 may be increased and magnetic flux leakage may be reduced.

The vibration system includes the voice coil 190 disposed in the first magnetic gap 141 and the second magnetic gap 151. When applied with an electric current, the voice coil 190 moves in back and forth directions while interacting with magnetic flux in the first magnetic gap 141 and the second magnetic gap 151. The vibration system further includes a bobbin 191 wound by the voice coil 190, a diaphragm 192 generating sound pressure by vibrating according to the movement of the voice coil 190, and a damper 194 guiding forward and backward motions of the voice coil 190 and restraining leftward and rightward motions of the voice coil 190. The vibration system further includes an edge 193 coupling an outside circumference of the diaphragm 192 to a frame 196, and a dust cap 195 preventing foreign substance from being infiltrated into the first magnetic gap 141 and the second magnetic gap 151.

A height Hc of the voice coil 190 may be designed suitably to interact with the magnetic fluxes in the first magnet gap 141 and the second magnetic gap 151. For example, the height Hc of the voice coil 190 may be equal to a sum of the thickness H140 of the first magnetic plate 140 and the thickness H160 of the spacer plate 160. Alternatively, the height Hc of the voice coil 190 may be equal to a sum of the thickness H150 of the second magnetic plate 150 and the thickness H160 of the spacer plate 160. Alternatively, the height Hc of the voice coil 190 may be equal to a sum of a half of the thickness H140 of the first magnetic plate 140, the thickness H160 of the spacer plate 160, and a half of the thickness H150 of the second magnetic plate 150. Alternatively, the height Hc of the voice coil 190 may be equal to a sum of the thickness H140 of the first magnetic plate 140, the thickness H160 of the spacer plate 160, and the thickness H150 of the second magnetic plate 150. Alternatively, the height Hc of the voice coil 190 may be greater or smaller than a sum of the thickness of the first magnetic plate 140, the thickness of the spacer plate 160, and the thickness H150 of the second magnetic plate 150.

When an electric current is not applied to the voice coil 190, the voice coil 190 may be positioned at a middle portion in an entire range of the first yoke 130.

Figure 4:
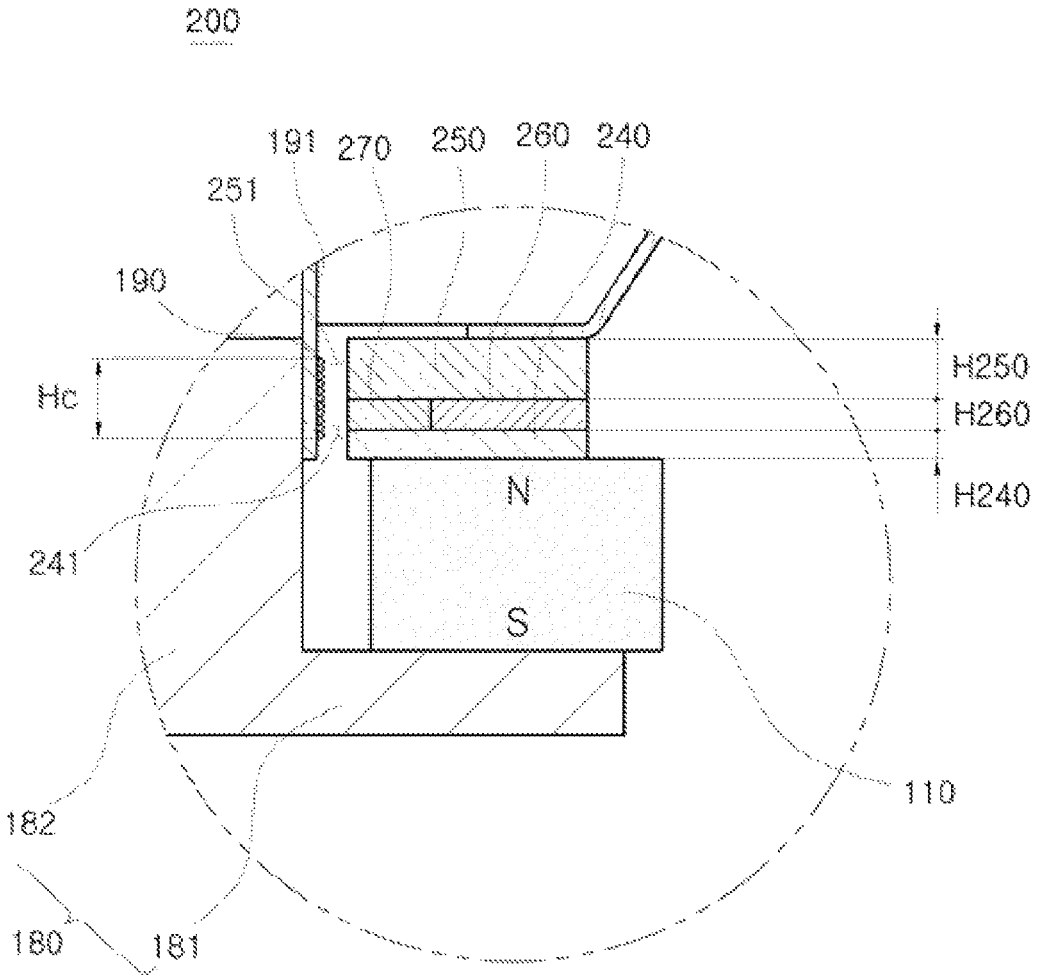
FIG. 4 is a cross-sectional view illustrating a main portion of a speaker unit in accordance with a second exemplary embodiment.
Figure 5:
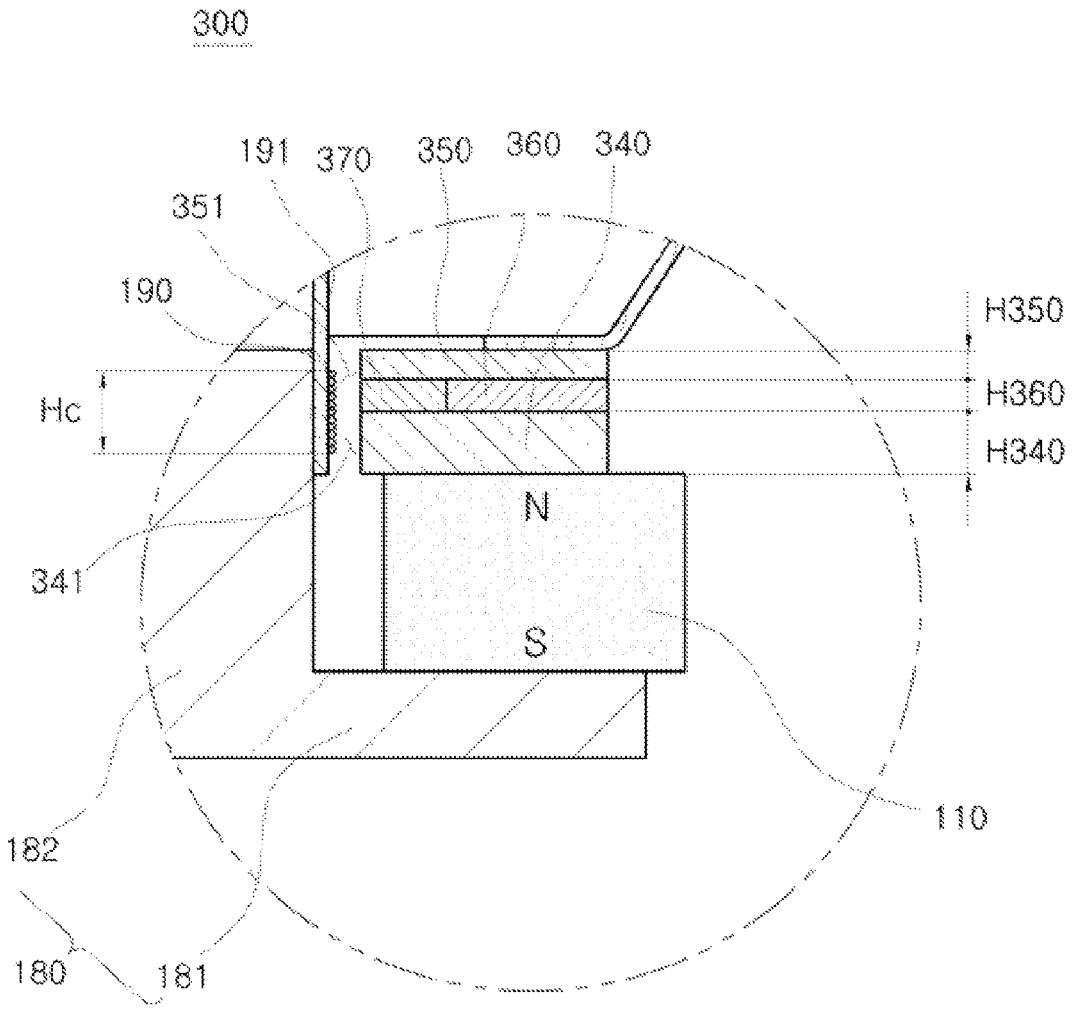
FIG. 5 is a cross-sectional view illustrating a main portion of a speaker unit in accordance with a third exemplary embodiment.

FIG. 4 is a cross-sectional view illustrating a main portion of a speaker unit in accordance with a second exemplary embodiment, and FIG. 5 is a cross-sectional view illustrating a main portion of a speaker unit in accordance with a third exemplary embodiment.

Referring to FIGS. 4 and 5, the speaker units according to the second and third exemplary embodiments will be described. In the following description, details of parts identical to the first exemplary embodiment will be omitted, and the same reference numerals are used to refer to the same elements in the exemplary embodiments.

Referring to FIG. 4, a speaker unit 200 includes a first magnetic plate 240 stacked in front of the magnet 110, a spacer plate 260 stacked in front of the first magnetic plate 240, a second magnetic plate 250 stacked in front of the spacer plate 260, and a short ring 270 inserted into an empty space formed between the first magnetic plate 240, the spacer plate 260, and the second magnetic plate 250. A first magnetic gap 241 is formed between the first magnetic plate 240 and the pole piece 182, and a second magnetic gap 251 is formed between the second magnetic plate 250 and the pole piece 182.

The first magnetic plate 240 may be provided in an approximate ring shape having hollowness, and is provided in a leveled shape having a constant thickness H240. The second magnetic plate 250 may be provided in an approximate ring shape having hollowness, and is provided in a leveled shape having a constant thickness H250. The spacer plate 260 is provided between the first magnetic plate 240 and the second magnetic plate 250 such that the first magnetic plate 240 is spaced apart from the second magnetic plate 250 by a predetermined interval. The spacer plate 260 may be provided in an approximate ring shape having hollowness, and is provided in a leveled shape having a constant thickness H260.

The thickness H250 of the second magnetic plate 250 is greater than the thickness H240 of the first magnetic plate 240. Accordingly, a magnetic flux in the second magnetic gap 251 may be greater than that in the first magnetic gap 241.

As such, the speaker unit 200 has an unbalanced structure in which the first magnetic plate 240 has the thickness H240 smaller than the thickness H250 of the second magnetic plate 250, so that the voice coil 190 performs a non-linear motion with respect to a zero point, thereby generating asymmetric sound waves and thus providing sound quality distinguished from general sound quality. For example, the speaker unit 200 may allow missing fundamental effect or enhanced even order harmonics to be improved, so that rich and warm sound quality are provided.

Missing fundamental effect represents a phenomenon that fundamental frequencies are perceived even if fundamentals are not present. For example, sound below a predetermined frequency may be perceived without having to reproduce the sound, if overtones of the frequency are appropriately generated.

Even order harmonics refers to a phenomenon that an even harmonic occurs when a signal enters a non-linear system with respect to a zero point, which adds the same tone one octave higher, thereby providing a sensation of rich sound. On the contrary, an odd harmonic may occur when a signal enters a linear system with respect to a zero point, thereby adding scale distorting components and thus generating offensive sound.

Referring to FIG. 5, a speaker unit 300 includes a first magnetic plate 340 stacked in front of the magnet 110 while forming a first magnetic gap 341 between the pole piece 182 and the first magnetic plate 340, a spacer plate 360 stacked in front of the first magnetic plate 340, a second magnetic plate 350 stacked in front of the spacer plate 360 while forming a second magnetic gap 351 between the pole piece 182 and the second magnetic plate 350, and a short ring 370 inserted into an empty space formed between the first magnetic plate 340, the spacer plate 360, and the second magnetic plate 350.

The speaker unit 300 has an unbalanced structure in which the second magnetic plate 350 has a thickness H350 smaller than a thickness H340 of the first magnetic plate 340.

Figure 6:
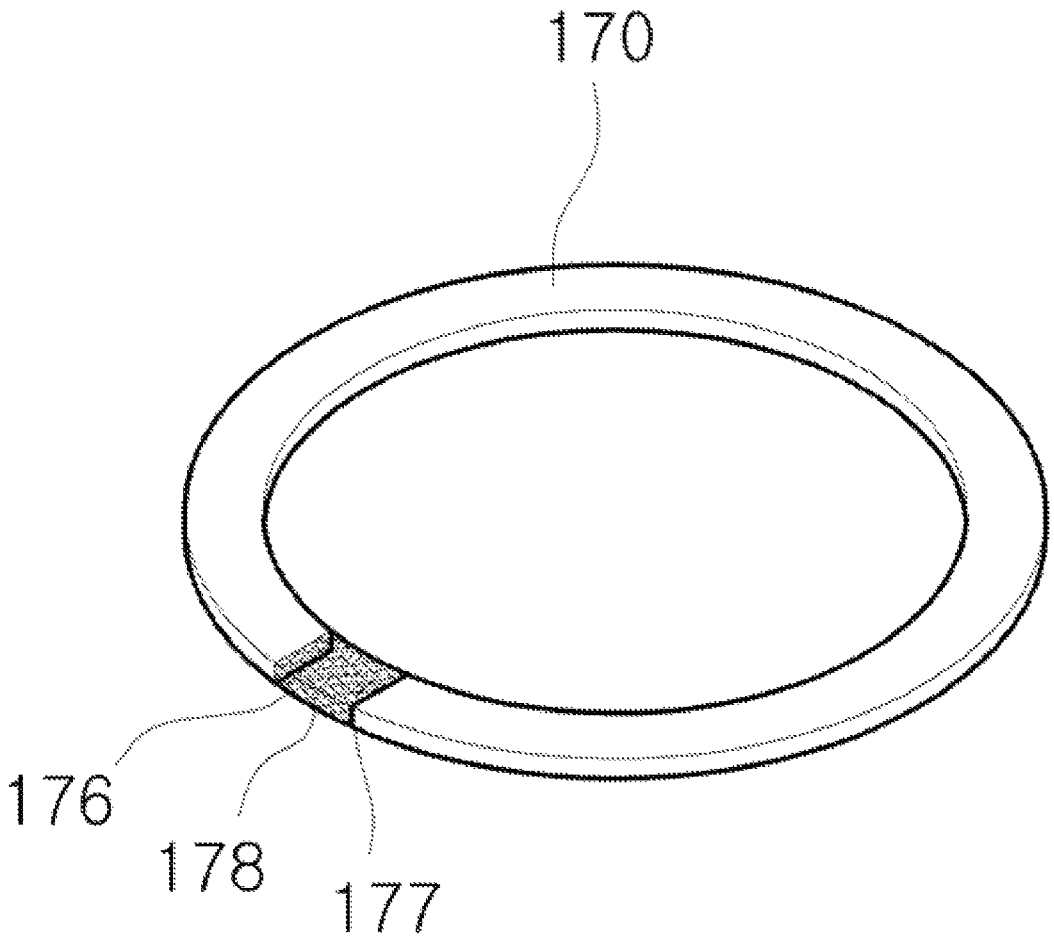
FIG. 6 is a view illustrating a magnetically permeable adhesive member provided between both open ends of a short ring of FIG. 1.

FIG. 6 is a view illustrating a magnetically permeable adhesive member formed between both open ends of a short ring of FIG. 1.

As described above, the short ring 170 is formed of material having a magnetic permeability lower than those of the first magnetic plate 140 and the second magnetic plate 150, such that magnetic flux is further concentrated on the first magnetic plate 140 and the second magnetic plate 150. In addition, the short ring 170 comes into close contact with the first magnetic plate 140 and the second magnetic plate 150, thereby firmly supporting the first magnetic plate 140 and the second magnetic plate 150.

In FIG. 6, the short ring 170 is provided in the form of a disconnected ring having open ends 176 and 177. An adhesive member 178 is provided between the open ends 176 and 177 to bond the open ends 176 and 177 to each other.

Figure 7:
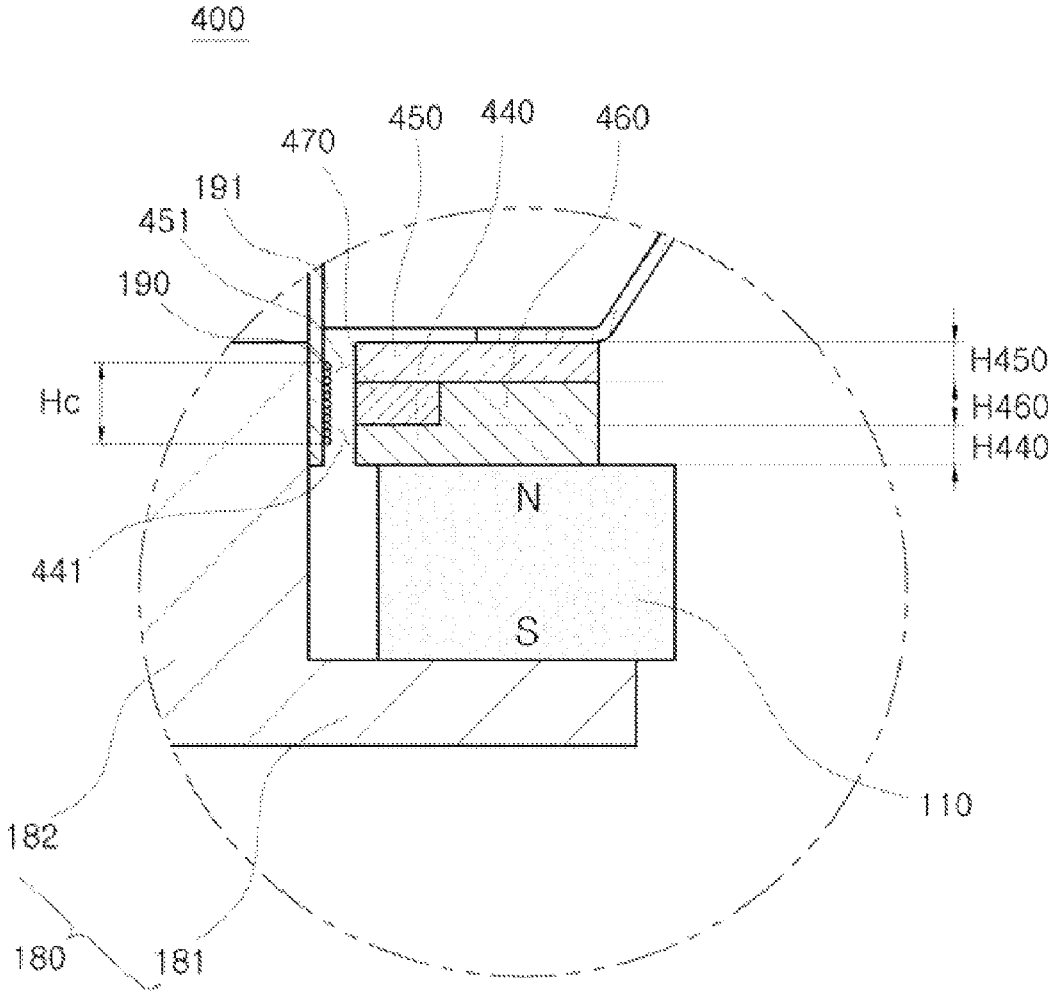
FIG. 7 is a cross-sectional view illustrating a main portion of a speaker unit in accordance with a fourth exemplary embodiment.
Figure 8:
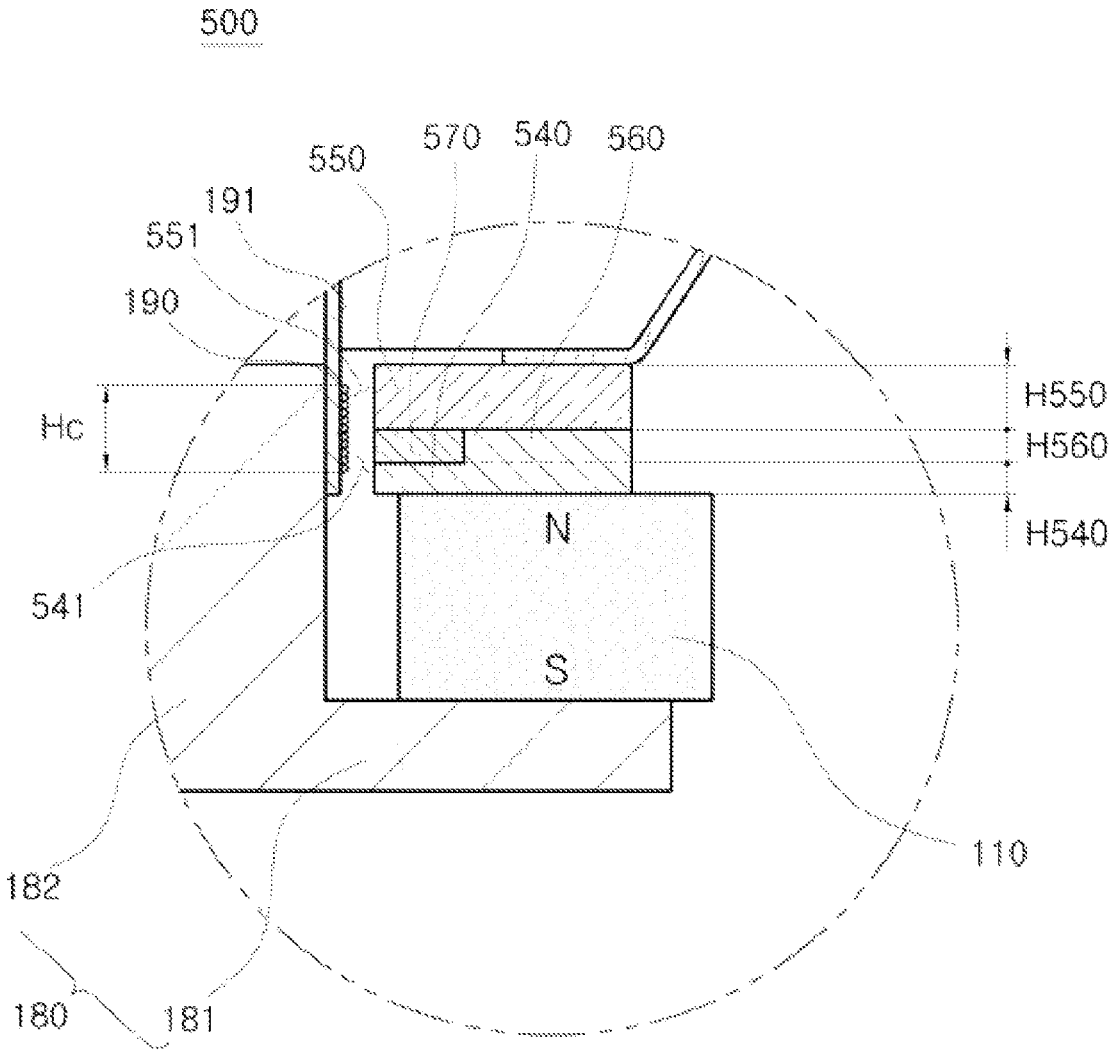
FIG. 8 is a cross-sectional view illustrating a main portion of a speaker unit in accordance with a fifth exemplary embodiment.
Figure 9:
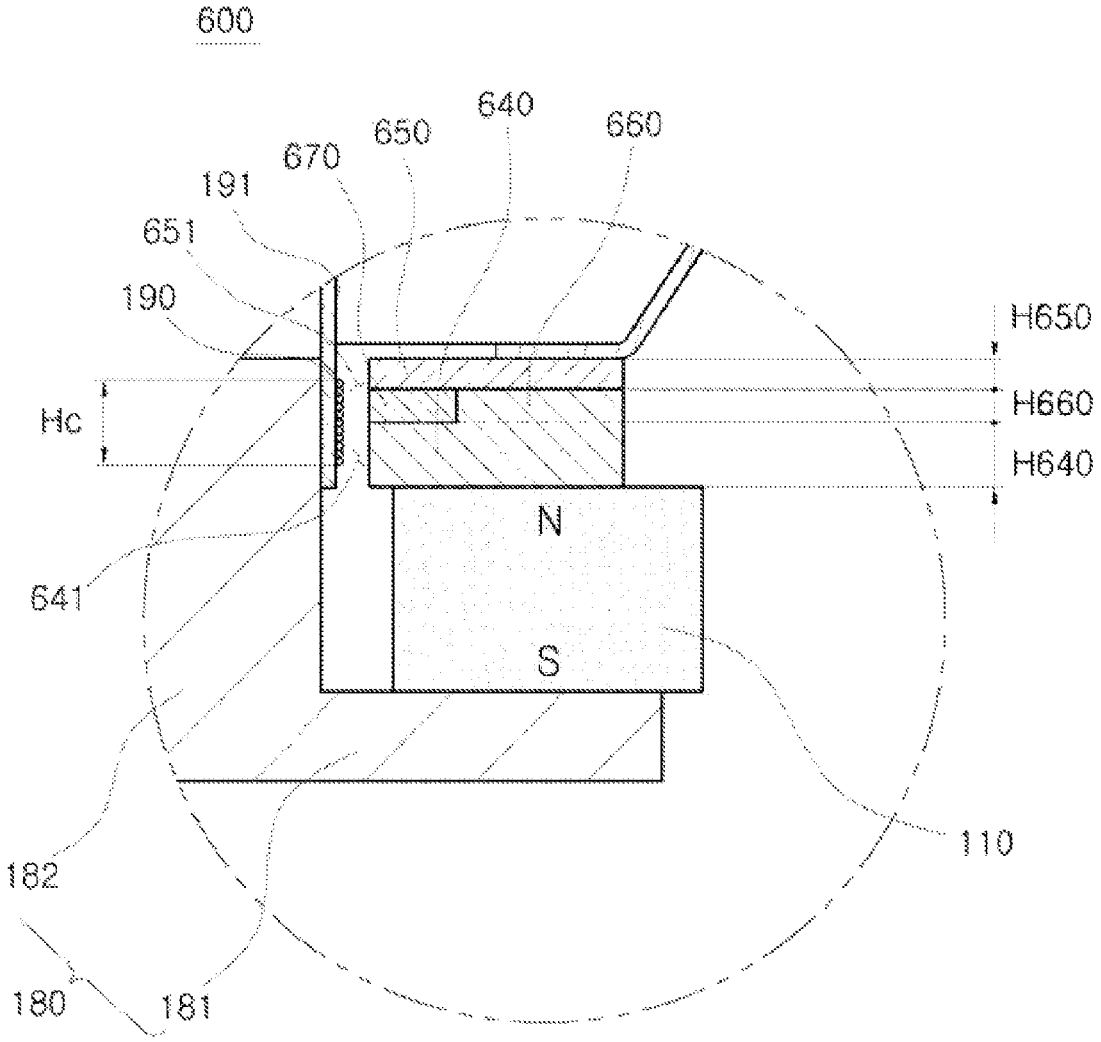
FIG. 9 is a cross-sectional view illustrating a main portion of a speaker unit in accordance with a sixth exemplary embodiment.

FIG. 7 is a cross-sectional view illustrating a main portion of a speaker unit in accordance with a fourth exemplary embodiment, FIG. 8 is a cross-sectional view illustrating a main portion of a speaker unit in accordance with a fifth exemplary embodiment, and FIG. 9 is a cross-sectional view illustrating a main portion of a speaker unit in accordance with a sixth exemplary embodiment.

Referring to FIGS. 7 to 9, the speaker units according to the fourth through sixth exemplary embodiments will be described. In the following description, details of parts identical to the first exemplary embodiment will be omitted, and the same reference numerals are used to refer to the same elements in the exemplary embodiments.

Speaker units 400, 500 and 600 include respective first magnetic plates 440, 540 and 640 stacked in front of the magnet 110 while forming respective first magnetic gaps 441, 541 and 641 between the pole piece 182 and the respective first magnetic plates 440, 540, and 640, respective spacer plates 460, 560 and 660 stacked in front of the respective first magnetic plates 440, 540 and 640. The speaker units 400, 500, and 600 further include respective second magnetic plates 450, 550 and 650 stacked in front of the respective spacer plates 460, 560 and 660 while forming respective second magnetic gaps 451, 551 and 651 between the pole piece 182 and the respective second magnetic plates 450, 550 and 650, and respective short rings 470, 570 and 670 inserted into respective empty spaces formed between the respective first magnetic plates 440, 540 and 640, the respective spacer plates 460, 560 and 660, and the respective second magnetic plates 450, 550 and 650.

The first magnetic plates 440, 540 and 640 and the respective spacer plates 460, 560 and 660 are integrally formed with each other, and the second magnetic plates 450, 550 and 650 are separately formed from the first magnetic plates 440, 540 and 640 and the spacer plates 460, 560 and 660 and coupled to the respective spacer plates 460, 560 and 660. Such configurations facilitate assemblies of the short rings 470, 570 and 670 while reducing a number of components of the speaker units 400, 500, and 600.

Although not shown in the drawings, the spacer plates 460, 560 and 660 and the respective second magnetic plates 450, 550 and 650 may be integrally formed with each other, and the first magnetic plates 440, 540 and 640 may be separately formed from the spacer plates 460, 560 and 660 and the second magnetic plates 450, 550 and 650 and coupled to the respective spacer plates 460, 560 and 660.

Referring to FIG. 7, the speaker unit 400 has a balanced structure in which the first magnetic plate 440 has a thickness H440 equal to a thickness H450 of the second magnetic plate 450.

Referring to FIG. 8, the speaker unit 500 has an unbalanced structure in which the first magnetic plate 540 has a thickness H540 smaller than a thickness H550 of the second magnetic plate 550.

Referring to FIG. 9, the speaker unit 600 has an unbalanced structure in which the first magnetic plate 640 has a thickness H640 greater than a thickness H650 of the second magnetic plate 650.

Reference numerals H460, H560 and H660 represent thicknesses of the respective spacer plates 460, 560 and 660.

Figure 10:
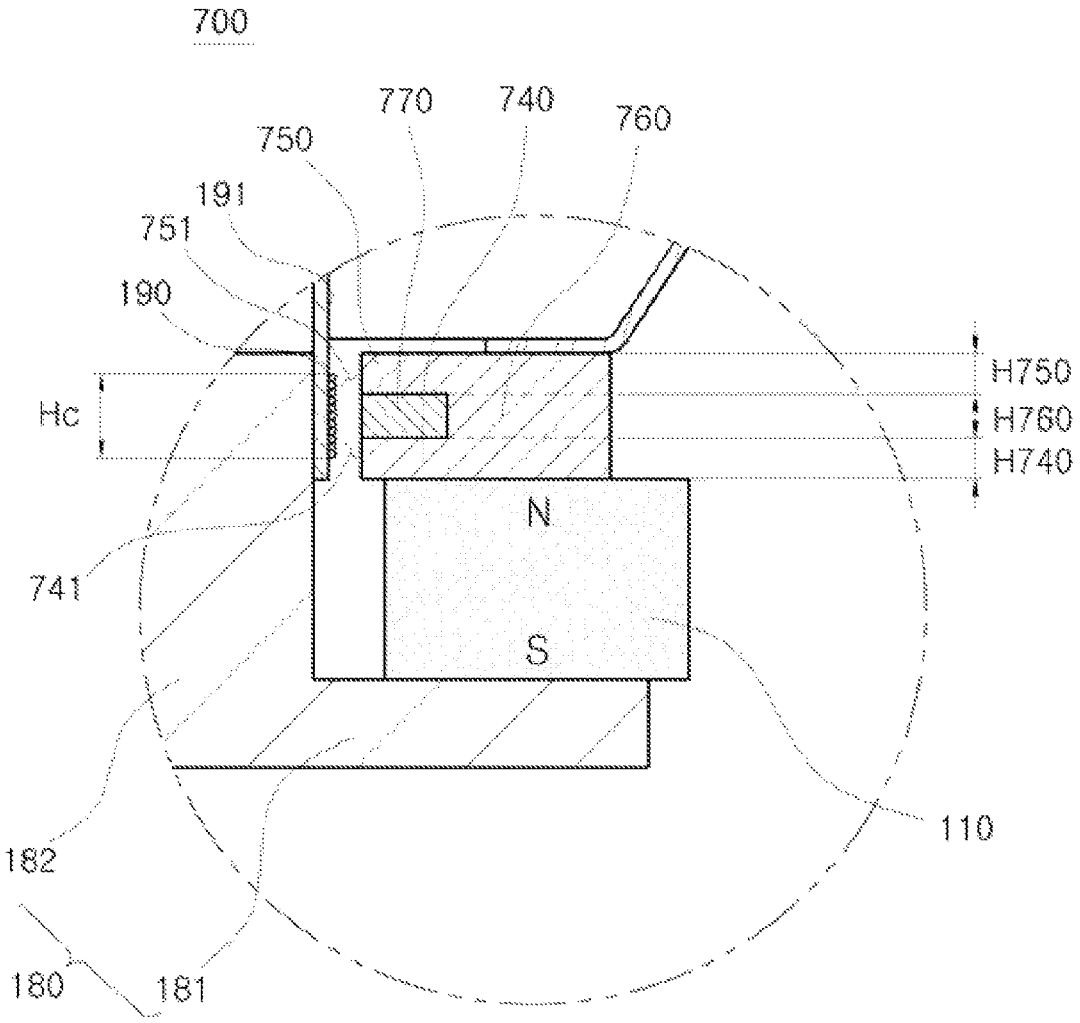
FIG. 10 is a cross-sectional view illustrating a main portion of a speaker unit in accordance with a seventh exemplary embodiment.
Figure 11:
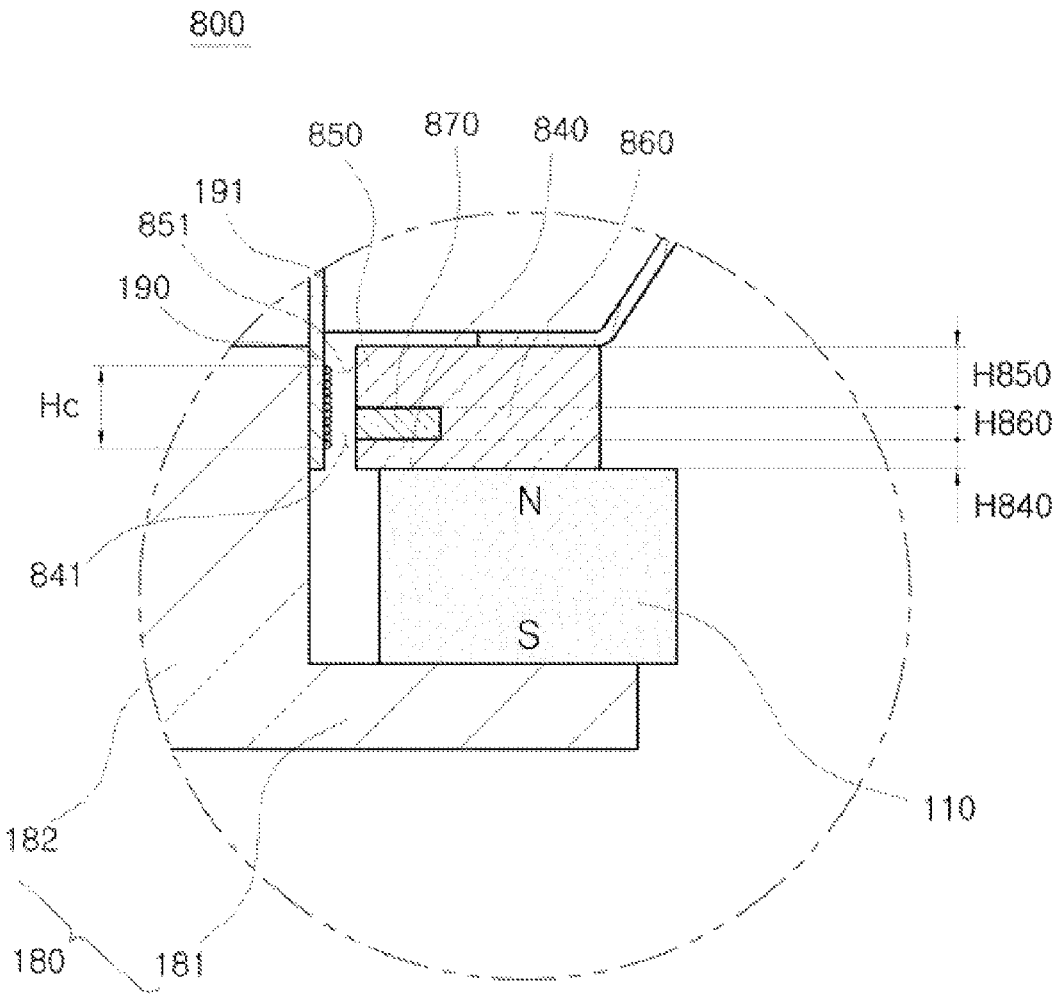
FIG. 11 is a cross-sectional view illustrating a main portion of a speaker unit in accordance with an eighth exemplary embodiment.
Figure 12:
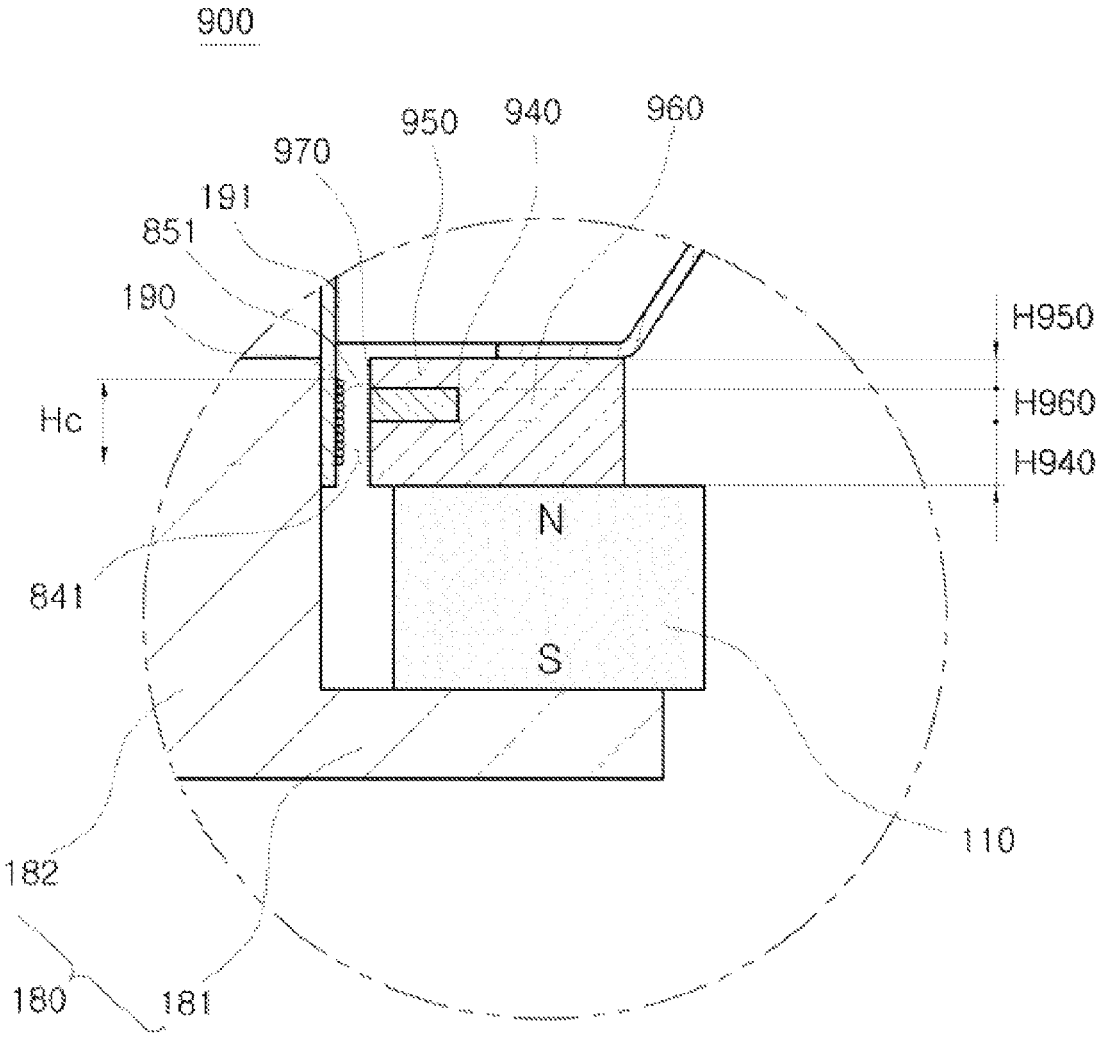
FIG. 12 is a cross-sectional view illustrating a main portion of a speaker unit in accordance with a ninth exemplary embodiment.

FIG. 10 is a cross-sectional view illustrating a main portion of a speaker unit in accordance with a seventh another exemplary embodiment, FIG. 11 is a cross-sectional view illustrating a main portion of a speaker unit in accordance with an eighth exemplary embodiment, and FIG. 12 is a cross-sectional view illustrating a main portion of a speaker unit in accordance with a ninth exemplary embodiment.

Referring to FIGS. 10 to 12, the speaker units according to the seventh through ninth exemplary embodiments will be described. In the following description, details of parts identical to the first exemplary embodiment will be omitted, and the same reference numerals are used to refer to the same elements in the exemplary embodiments.

Speaker units 700, 800 and 900 include respective first magnetic plates 740, 840 and 940 stacked in front of the magnet 110 while forming respective first magnetic gaps 741, 841 and 941 between the pole piece 182 and the respective first magnetic plates 740, 840 and 940, and respective spacer plates 760, 860 and 960 stacked in front of the respective first magnetic plates 740, 840 and 940. The speaker units 700, 800, and 900 include respective second magnetic plates 750, 850 and 950 stacked in front of the respective spacer plates 760, 860 and 960 while forming respective second magnetic gaps 751, 851 and 951 between the pole piece 182 and the respective second magnetic plates 750, 850 and 950, and respective short rings 770, 870 and 970 inserted into respective empty spaces formed between the respective first magnetic plates 740, 840 and 940, the respective spacer plates 760, 860 and 960 and the respective second magnetic plates 750, 850 and 950.

The first magnetic plates 740, 840 and 940, the respective spacer plates 760, 860 and 960, and the respective second magnetic plates 750, 850, and 950 are integrally formed with each other, so that a number of components of the speaker units 700, 800 and 900 is reduced.

Referring to FIG. 10, the speaker unit 700 has a balanced structure in which the first magnetic plate 740 has a thickness H740 equal to a thickness H750 of the second magnetic plate 750.

Referring to FIG. 11, the speaker unit 800 has an unbalanced structure in which the first magnetic plate 840 has a thickness H840 smaller than a thickness H850 of the second magnetic plate 850.

Referring to FIG. 12, the speaker unit 900 has an unbalanced structure in which the first magnetic plate 940 has a thickness H940 greater than a thickness H950 of the second magnetic plate 950.

Reference numerals H760, H860 and H960 represent thicknesses of the respective spacer plates 760, 860 and 960.

Figure 13:
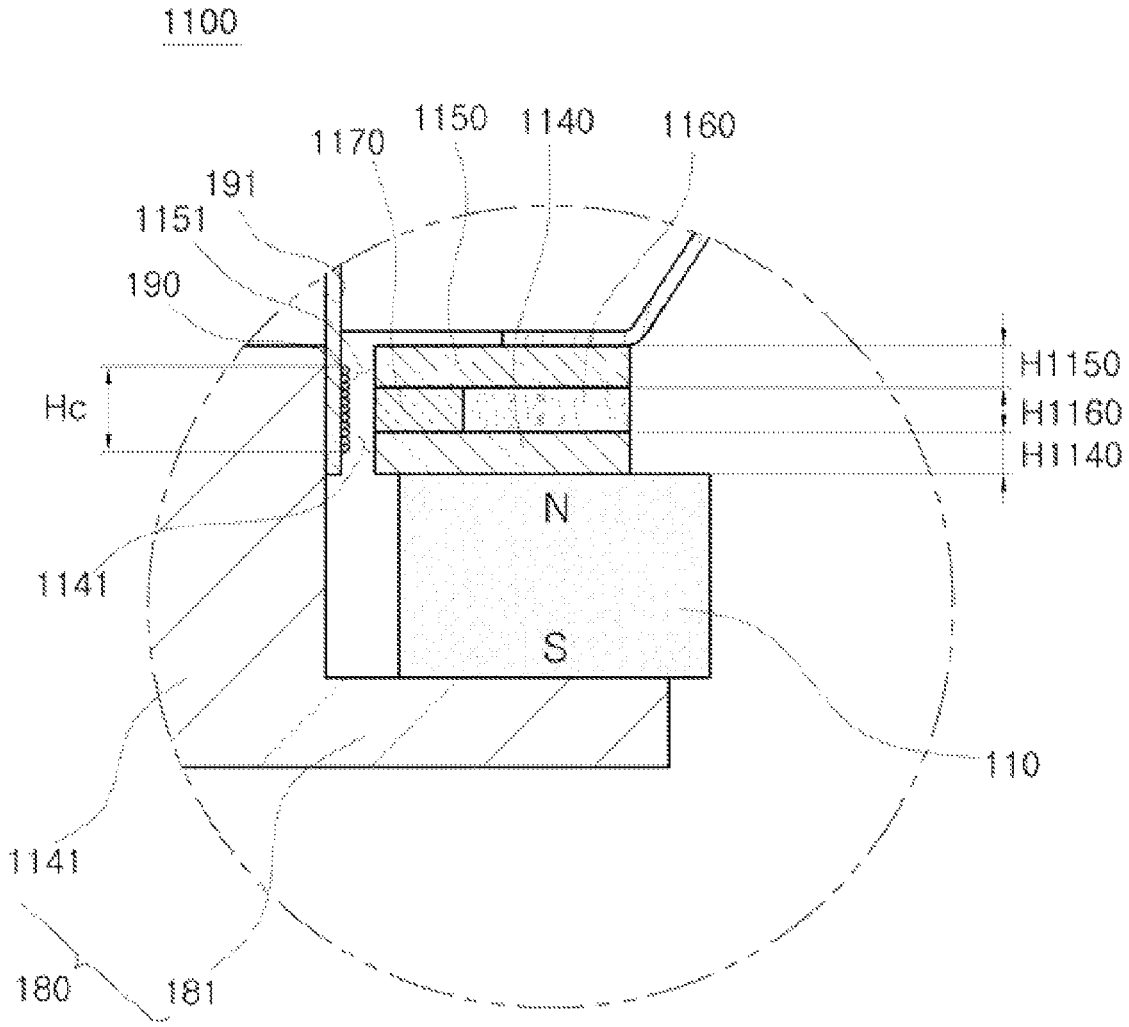
FIG. 13 is a cross-sectional view illustrating a main portion of a speaker unit in accordance with a tenth exemplary embodiment.
Figure 14:
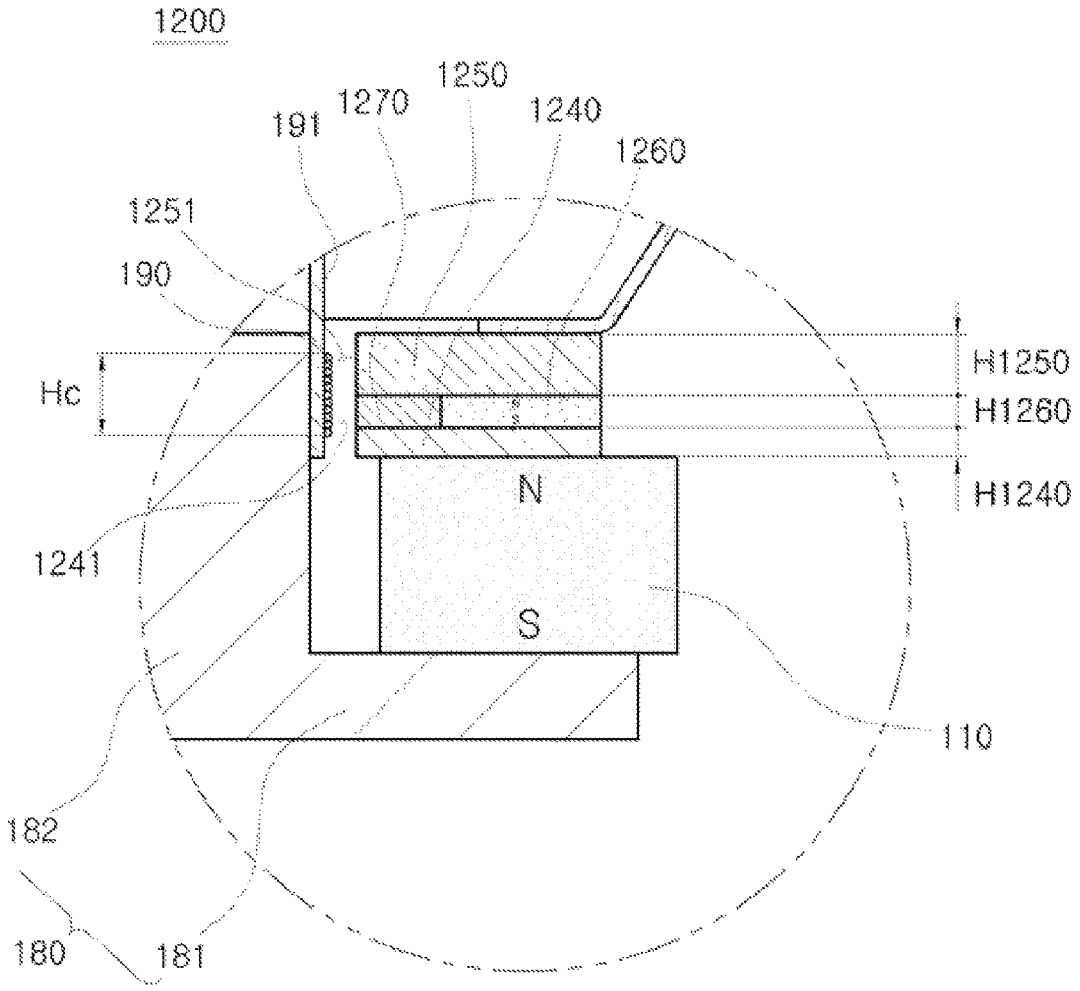
FIG. 14 is a cross-sectional view illustrating a main portion of a speaker unit in accordance with an eleventh exemplary embodiment.
Figure 15:
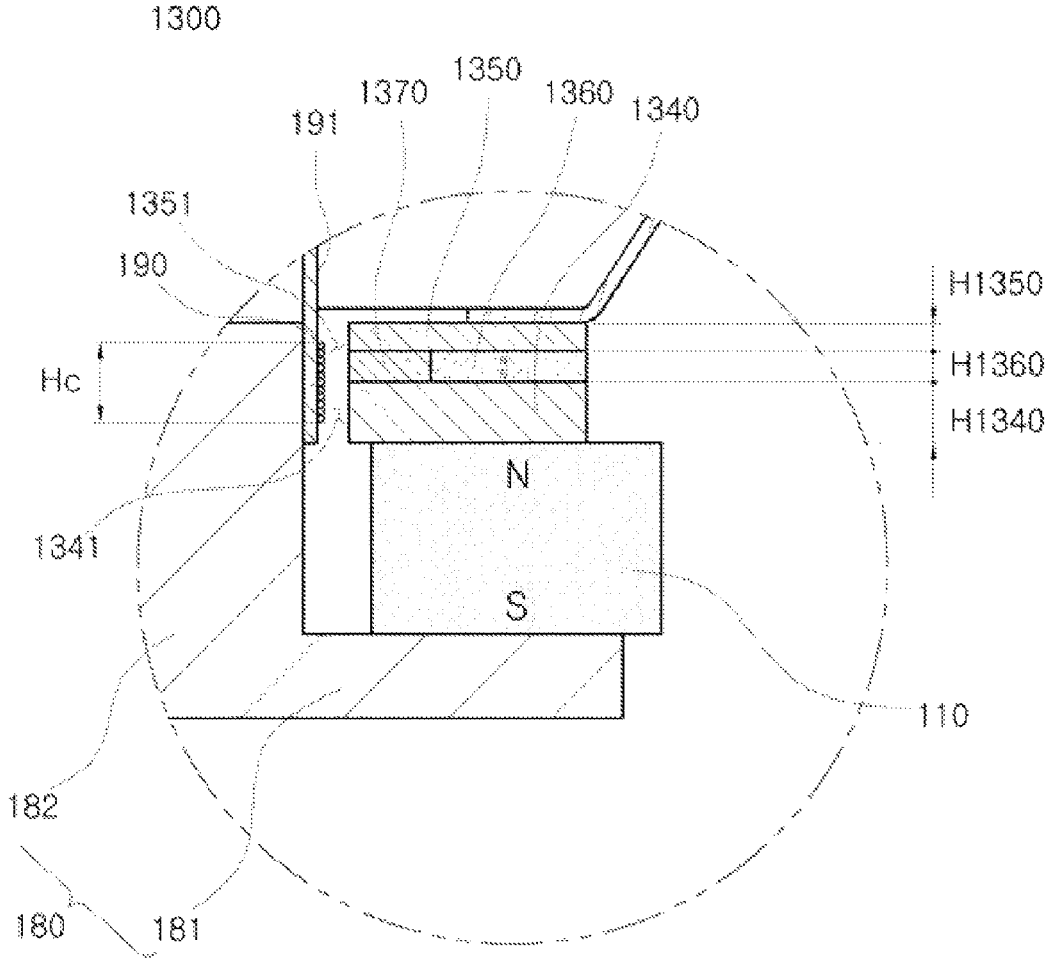
FIG. 15 is a cross-sectional view illustrating a main portion of a speaker unit in accordance with a twelfth exemplary embodiment.

FIG. 13 is a cross-sectional view illustrating a main portion of a speaker unit in accordance with a tenth exemplary embodiment, FIG. 14 is a cross-sectional view illustrating a main portion of a speaker unit in accordance with an eleventh exemplary embodiment, and FIG. 15 is a cross-sectional view illustrating a main portion of a speaker unit in accordance with a twelfth exemplary embodiment.

Referring to FIGS. 13 to 15, the speaker units according to the tenth through twelfth exemplary embodiments will be described. In the following description, details of parts identical to the first exemplary embodiment will be omitted, and the same reference numerals are used to refer to the same elements in the exemplary embodiments.

Speaker units 1100, 1200 and 1300 include respective first magnets 1110, 1210 and 1310 having a plurality of poles and generating magnetic flux, and respective first magnetic plates 1140, 1240 and 1340 stacked in front of the respective first magnets 1110, 1210 and 1310 while forming respective first magnetic gaps 1141, 1241 and 1341 between the pole piece 182 and the respective first magnetic plates 1140, 1240 and 1340. The speaker units 1100, 1200, and 1300 further include respective second magnets 1160, 1260 and 1360 stacked in front of the respective first magnetic plates 1140, 1240 and 1340 while having a plurality of poles and generating magnetic flux, and respective second magnetic plates 1150, 1250 and 1350 stacked in front of the respective second magnets 1160, 1260 and 1360 while forming respective second magnetic gaps 1151, 1251 and 1351 between the pole piece 182 and the respective second magnetic plates 1150, 1250 and 1350. The speaker units 1100, 1200, and 1300 further include respective short rings 1170, 1270 and 1370 inserted into respective empty spaces formed between the respective first magnetic plates 1140, 1240 and 1340, the respective second magnets 1160, 1260 and 1360, and the respective second magnetic plates 1150, 1250 and 1350.

The second magnets 1160, 1260 and 1360 and the first magnets 1110, 1210 and 1310 are magnetized in the same direction. The use of the second magnets 1160, 1260 and 1360 instead of spacer plates may increase material cost, but increase a strength of magnetic flux, thereby improving the sound quality.

Referring to FIG. 13, the speaker unit 1100 has a balanced structure in which the first magnetic plate 1140 has a thickness H1140 equal to a thickness H1150 of the second magnetic plate 1150.

Referring to FIG. 14, the speaker unit 1200 has an unbalanced structure in which the first magnetic plate 1240 has a thickness H1240 smaller than a thickness H1250 of the second magnetic plate 1250.

Referring to FIG. 15, the speaker unit 1300 has an unbalanced structure in which the first magnetic plate 1340 has a thickness H1340 greater than a thickness H1350 of the second magnetic plate 1350.

Reference numerals H1160, H1160 and H1160 represent thicknesses of the respective second magnets 1160, 1260 and 1360.

As is apparent from the above, the speaker unit has the plurality of gaps, the moved distance of the voice coil may be increased, and the magnetic flux leakage may be reduced, so that improved sound quality can be provided. Distinguished sound quality can be provided through an unbalanced structure.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. A speaker unit comprising:

a magnet having poles and generating magnetic flux;

a yoke part forming a path of the magnetic flux and comprising a first yoke extending from one of the poles, a second yoke extending from another one of the poles, and magnetic gaps disposed between the first yoke and the second yoke;

a voice coil disposed between the magnetic gaps and moving when applied with an electric current; and a diaphragm generating sound pressure while vibrating according to the movement of the voice coil, wherein the first yoke comprises annular magnetic plates protruding toward the second yoke, and the magnetic plates have thicknesses different from each other in an axial direction.

2. The speaker unit of claim 1, wherein the magnetic plates comprise a first magnetic plate provided at a rear side and a second magnetic plate provided at a front side.

3. The speaker unit of claim 2, wherein the second magnetic plate has a thickness greater than a thickness of the first magnetic plate.

4. The speaker unit of claim 2, wherein the second magnetic plate has a thickness smaller than a thickness of the first magnetic plate.

5. The speaker unit of claim 2, wherein the first yoke further comprises a spacer plate directly disposed between the first magnetic plate and the second magnetic plate.

6. The speaker unit of claim 5, wherein an empty space is disposed between the first magnetic plate, the second magnetic plate, and the spacer plate.

7. The speaker unit of claim 5, wherein the first magnetic plate, the spacer plate, and the second magnetic plate are separately formed from each other and coupled to each other.

8. The speaker unit of claim 5, wherein the first magnetic plate, the spacer plate, and the second magnetic plate are integrally formed with each other.

9. The speaker unit of claim 5, wherein the first magnetic plate and the spacer plate are integrally formed with each other, and the second magnetic plate is separately formed from the first magnetic plate and the spacer plate and coupled to the spacer plate.

10. The speaker unit of claim 5, wherein the voice coil has a height equal to a sum of the thickness of the first magnetic plate and a thickness of the spacer plate.

11. The speaker unit of claim 5, wherein the voice coil has a height equal to a sum of the thickness of the second magnetic plate and a thickness of the spacer plate.

12. The speaker unit of claim 5, wherein the voice coil has a height equal to a sum of a half of the thickness of the first magnetic plate, a thickness of the spacer plate, and a half of the thickness of the second magnetic plate.

13. The speaker unit of claim 5, wherein the voice coil has a height equal to a sum of the thickness of the first magnetic plate, a thickness of the spacer plate, and the thickness of the second magnetic plate.

14. The speaker unit of claim 5, wherein the voice coil has a height greater than a sum of the thickness of the first magnetic plate, a thickness of the spacer plate, and the thickness of the second magnetic plate.

15. The speaker unit of claim 5, wherein the voice coil has a height smaller than a sum of the thickness of the first magnetic plate, a thickness of the spacer plate, and the thickness of the second magnetic plate.

16. The speaker unit of claim 5, wherein the first yoke further comprises a short ring disposed in an empty space disposed between the first magnetic plate, the second magnetic plate, and the spacer plate, the short ring concentrating the magnetic flux on the magnetic plate and supporting the magnetic plate.

17. The speaker unit of claim 16, wherein the short ring has a magnetic permeability lower than a magnetic permeability of the magnetic plate.

18. The speaker unit of claim 16, wherein the short ring has a shape of a closed ring.

19. The speaker unit of claim 16, wherein the short ring has a shape of a ring having disconnected ends.

20. The speaker unit of claim 19, wherein the first yoke further comprises a magnetically permeable adhesive member disposed between the disconnected ends of the short ring.

21. The speaker unit of claim 5, wherein the spacer plate and the second magnetic plate are integrally formed with each other, and the first magnetic plate is separately formed from the spacer plate and the second magnetic plate and coupled to the spacer plate.

22. The speaker unit of claim 1, wherein:

the second yoke comprises a pole piece, and the magnet has an annual shape, the magnet being disposed around the pole piece.

23. The speaker unit of claim 5, wherein the spacer plate has a comprises a same outer diameter as a diameter of at least one of the first magnetic plate and the second magnetic plate, the spacer plate comprising a material of steel, an alloy, or a magnetic material having a low magnetic resistance.

24. A speaker unit comprising:

a magnet having poles and generating magnetic flux;

a pole piece forming a path of the magnetic flux;

an annular first magnetic plate forming a first magnetic gap between the pole piece and the first magnetic plate;

an annular spacer plate disposed on the first magnetic plate;

an annular second magnetic plate disposed on the spacer plate and forming a second magnetic gap between the pole piece and the second magnetic plate;

a short ring inserted into a groove formed between the first magnetic plate, the second magnetic plate, and the spacer plate; and a voice coil moving while disposed in the first magnetic gap and the second magnetic gap, wherein the first magnetic plate and the second magnetic plate have thicknesses different from each other in an axial direction.

25. The speaker unit of claim 24, wherein the short ring has a magnetic permeability lower than a magnetic permeability of the first magnetic plate and a magnetic permeability of the second magnetic plate.

26. The speaker unit of claim 25, wherein the short ring has a shape of a closed ring.

27. The speaker unit of claim 25, wherein the short ring has a shape of a ring having disconnected ends.

28. The speaker unit of claim 27, further comprising:

a magnetically permeable adhesive member disposed between the disconnected ends of the short ring.

29. The speaker unit of claim 25, wherein a thickness of the short ring is equal to or less than the thickness of the spacer plate.

30. A speaker unit comprising:

a first magnet having poles and generating magnetic flux;

a pole piece forming a path of the magnetic flux;

an annular first magnetic plate disposed on the magnet and forming a first magnetic gap between the pole piece and the first magnetic plate;

an annular second magnet disposed on the first magnetic plate;

an annular second magnetic plate disposed on the second magnet and forming a second magnetic gap between the pole piece and the second magnetic plate; and a voice coil moving while disposed in the first magnetic gap and the second magnetic gap, wherein the first magnetic plate and the second magnetic plate have thicknesses different from each other in an axial direction.

* * * * *